United States Patent [19]

Weindorf

[11] Patent Number: 4,712,047

[45] Date of Patent: Dec. 8, 1987

[54] POWER ON DEMAND BEAM DEFLECTION SYSTEM FOR DUAL MODE CRT DISPLAYS

[75] Inventor: Paul F. L. Weindorf, Albuquerque, N. Mex.

[73] Assignee: Sperry Corporation, Great Neck, N.Y.

[21] Appl. No.: 879,730

[22] Filed: Jun. 27, 1986

[51] Int. Cl.[4] ..... H01J 29/70

[52] U.S. Cl. ..... 315/397; 315/396; 315/387; 315/389; 315/364

[58] Field of Search ..... 315/395, 397, 396, 403, 315/389, 364

[56] References Cited

U.S. PATENT DOCUMENTS

| | | | |
|---|---|---|---|
| 3,479,553 | 11/1969 | Yanishevsky et al. | 315/397 |
| 3,727,096 | 4/1973 | Wilcox | 315/395 |
| 3,859,557 | 1/1975 | Grant et al. | 315/395 |
| 3,887,847 | 6/1975 | Owen, Jr. et al. | 315/397 |
| 3,965,390 | 6/1976 | Spencer, Jr. | 315/397 |
| 4,164,688 | 8/1979 | Cushing | 315/397 |
| 4,188,567 | 2/1980 | Monroe | 315/389 |
| 4,262,235 | 4/1981 | Neves et al. | 315/397 |
| 4,297,621 | 10/1981 | Spilsburg | 315/397 |
| 4,302,708 | 11/1981 | Spilsburg | 315/389 |
| 4,314,184 | 2/1982 | Ryan | 315/397 |
| 4,361,785 | 11/1982 | Stapleton | 315/389 |

*Primary Examiner*—Leo H. Boudreau
*Assistant Examiner*—Michael Razavi
*Attorney, Agent, or Firm*—Arnold L. Albin

[57] ABSTRACT

A cathode ray beam deflection system operable in slew and random stroke and periodic raster display modes provides automatic power supply voltage switching to maintain linear operation and high efficiency. Control of automatic switching is obtained by continuously monitoring yoke voltage, yoke current, and deflection voltage, a power supply voltage being switched to a voltage of higher magnitude to provide a higher deflection rate when the yoke voltage exceeds a predetermined level at a predetermined current polarity and returned to a power supply voltage of lower magnitude when the higher deflection rate is no longer required.

7 Claims, 6 Drawing Figures

+45 V
A
27
POSITIVE POWER SWITCH
+15 V
68
16
CR1
53c
53b
45
VH
Q13
+45 V
53a
CR2
CR13
55c
55b
B
Q3
CR14
66
65
VF
-15 V
CR11
55a
67
28
57c
57b
C
Q5
46

AMP 14
57c
52
VO
42
59c
59b
D
Q6
20
IC
59a
54
18
CR16
61c
CR12
VG
+15 V
61b
30
E
Q4
72
32
CR15
61a
63a
CR9
-45 V
56
51
63b
Q14
VI
22
CR10
63c
74
58
43
NEGATIVE POWER SWITCH
-15V
76
F
-45 V
G

POWER ON DEMAND BEAM DEFLECTION SYSTEM FOR DUAL MODE CRT DISPLAYS

BACKGROUND OF THE INVENTION

1. Field of the Invention

The invention relates generally to electromagnetically deflected beam display systems and more particularly to power supply control circuits for providing linear operation and high efficiency in random stroke and periodic raster display modes and during slew of a cathode ray tube electron beam.

2. Description of the Prior Art

The power efficiency of deflection systems that display both raster and stroke writing is relatively low due to the inductive deflection yoke and the high driving voltages required for magnetic deflection to assure adequate writing speed. Sophisticated airborne navigation displays with increased display area and information content require a significant increase in power consumption, while space and available power is limited. Since the deflection yoke driving circuit consumes a significant portion of the total display power, the power efficiency of the deflection system may be greatly enhanced if the required driving voltages can be reduced.

Since the rate of deflection for a raster display is generally much higher than for stroke deflection, the supply voltages applied for raster deflection are correspondingly higher. To obtain maximum slew speed during the stroke display also requires a relatively high supply voltage or reduced yoke inductance, both of which increase power dissipation of the system. However, during the writing phase of the stroke display, relatively low voltages may be satisfactory. Hence it is desirable to switch the power applied to the system to provide the minimum voltage required to assure linear operation.

One form of prior art apparatus providing dynamic power reduction was disclosed in U.S. Pat. No. 3,965,390, Power On Demand Beam Deflection System for CRT Displays, issued June 22, 1976 to James M. Spencer, Jr. and assigned to the assignee of the present invention. This invention utilized a flyback raster for retrace and provided reduced supply voltage only during the stroked deflection period when reduced writing speed was allowable.

An improved system is described in Ser. No. 858,149, Power As Required Beam Deflection System For CRT Displays With Raster Supply Switching, invented by W. W. Goldman and also assigned to the assignee of the present invention. Goldman provided an external raster/stroke control signal from a symbol generator to selectively apply a plurality of power supply sources to a push-pull yoke driver amplifier in accordance with the displayed mode of operation. Efficiency was further enhanced during raster operation by applying a control signal derived from the voltage developed across the yoke to synchronize the power switch closures. However, the limited voltage available during the stroke period resulted in inadequate high speed slewing capability. Further, it was desirable to eliminate the need for an external raster/stroke control signal inorder to minimize the complexity of the display circuitry.

The present invention describes a system for optimizing power conservation during the raster and stroke displays while permitting increased slewing speed. The invention is controlled by internal signals developed in the yoke driver amplifier without the need for external control signals. Since the internal switch control signals do not discriminate between stroke and raster operation, stroke writing efficiency is optimized even at high slewing speeds. Moreover, minimum power dissipation is also obtained during slewing conditions by varying the applied yoke driver voltages to that required to obtain linear operation.

SUMMARY OF THE INVENTION

A deflection system for a cathode ray tube employing a magnetic deflection coil to position the beam of a cathode ray tube along its face comprises a differential amplifier, a feedback element, a deflection amplifier, a plurality of voltage sources, a preamplifier, and a plurality of switches. The differential amplifier responds to beam positional signals and to a feedback signal representative of the current through the deflection coil. The error signal thereby developed is coupled to drive the preamplifier, which in turn causes the deflection amplifier to provide a current proportional to the input signal to the deflection coil. The switches are connected to the voltage sources to selectively and independently supply the deflection amplifier with sufficient current to maintain linear operation in raster, stroke, and slew modes of operation while minimizing power consumption. Control signals for activating the switches are derived by sensing the voltage developed across the deflection coil and the current flowing therethrough. By applying one of the voltage sources to the deflection amplifier when a first voltage level is developed across the deflection coil, and switching to a second voltage source when a second voltage level is developed across the deflection coil, independent of the display mode and dependent only in the rate of change of current in coil, power consumption is minimized while providing high rates of deflection speed.

DESCRIPTION OF THE PREFERRED EMBODIMENT

Figure 1:
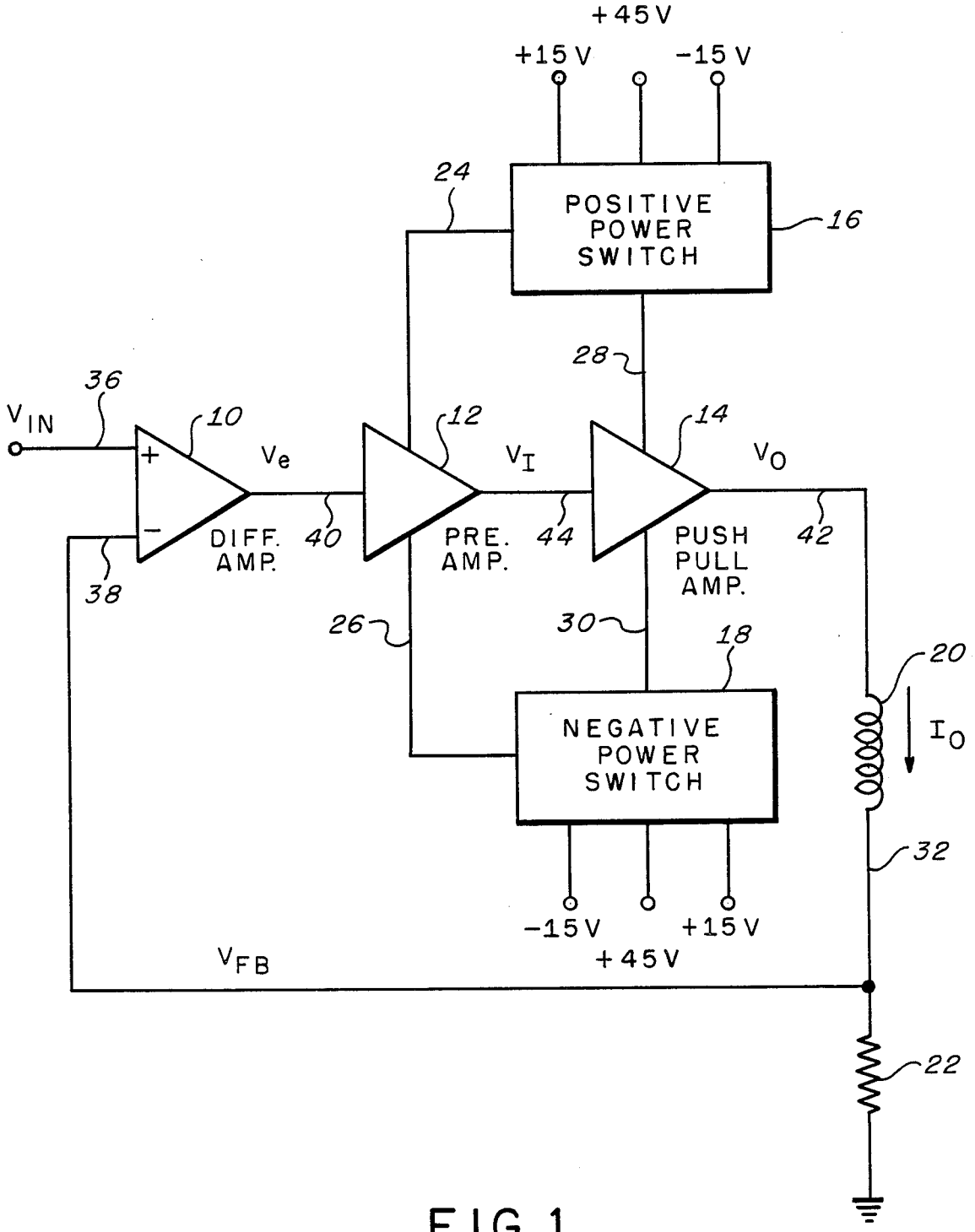
FIG. 1 is a functional block diagram of the apparatus of the present invention.

Referring to FIG. 1, a power on demand electron beam magnetic deflection system operable to provide linear deflection in the stroke mode for random deflection of the beam and while slewing the beam, and in the raster mode for periodic deflection of the beam, includes a differential amplifier 10, a preamplifier 12, a push-pull amplifier stage 14, a deflection yoke 20 mounted on a cathode ray tube (CRT) (not shown), and a yoke current sampling resistor 22. A positive power switch 16 coupled to receive current from a plurality of power supplies +15 V, +45 V, and −15 V receives control signals from preamplifier 12 on line 24 and energizes push-pull amplifier 14 on line 28. A negative power switch 18 receives current from −15 V, −45 V, and +15 V power supplies and control signals from preamplifier 12 via line 26, and provides current to push-pull amplifier 14 on line 30. An input signal $V_{IN}$, representative of the desired beam deflection, which may be in stroke mode, raster mode, or during slewing of the beam, is applied on line 36 to the non-inverting input of differential amplifier 10. A feedback signal $V_{FB}$, derived by sensing a voltage drop across resistor 22 proportional to yoke current $I_O$, is provided on line 38 to the inverting input of differential amplifier 10. The two signals are algebraically subtracted and amplified in differential amplifier 10 to provide an error signal $V_e$ on line 40 which is coupled to the input of preamplifier 12. Preamplifier 12 provides an amplified voltage $V_I$ for driving push-pull amplifier 14. Amplifier 14 operates in a conventional manner to provide an output signal $V_O$ on line 42 for driving a magnetizing current $I_O$ through deflection yoke 20. The current $I_O$ also flows through series connected line 32 to sampling resistor 22 to develop a feedback signal $V_{FB}$. The signal $V_{FB}$ is proportional in magnitude and polarity to the current $I_O$. When impressed on differential amplifier 10 in a closed loop manner, with linear amplifier operation, the resultant current $I_O$ is directly proportional to $V_{IN}$.

In operation, a deflection signal $V_{IN}$ is applied to differential amplifier 10 to develop an output signal $V_e$. Signal $V_e$ is amplified by preamplifier 12 to provide a driving signal $V_I$ to push-pull amplifier 14. Amplifier 14 provides an output signal $V_O$ to energize deflection yoke 20. The current $I_O$ flowing in yoke 20 is sampled in series resistor 22 to develop a feedback signal $V_{FB}$ which is proportional to the current $I_O$. Differential amplifier 10 algebraically combines $V_{IN}$ and $V_{FB}$ to develop resultant signal $V_e$. This signal drives the preamplifier 12 and push-pull amplifier 14 in closed loop fashion so that the current waveform $I_O$ replicates the deflection signal $V_{IN}$.

In accordance with the driving voltage $V_O$ required to generate a desired yoke current, which in turn is a function of the writing speed, power switches 16 and 18 are individually energized to select one of a plurality of power supplies in accordance with substantially the minimum supply voltage required to assure linear operation.

For the positive power switch 16, which energizes yoke 20 when positive deflection current is demanded, a control signal on line 24 from preamplifier 12 energizes power switch 16. This control signal is responsive to the deflection command $V_{IN}$ on line 36 and to the feedback signal $V_{FB}$ on line 38. The magnitude of signal $V_O$ is sensed and communicated to switch 16 through amplifier 14. The combination of these signals determines which of the supplies coupled to switch 16 will be made available on line 28 to push-pull amplifier 14. The operation of negative power switch 18, which energizes yoke 20 when negative deflection curent is commanded, follows in a similar manner to energize the lower section of push-pull amplifier 14 in response to control signals on lines 26 and 30.

Figure 2B:
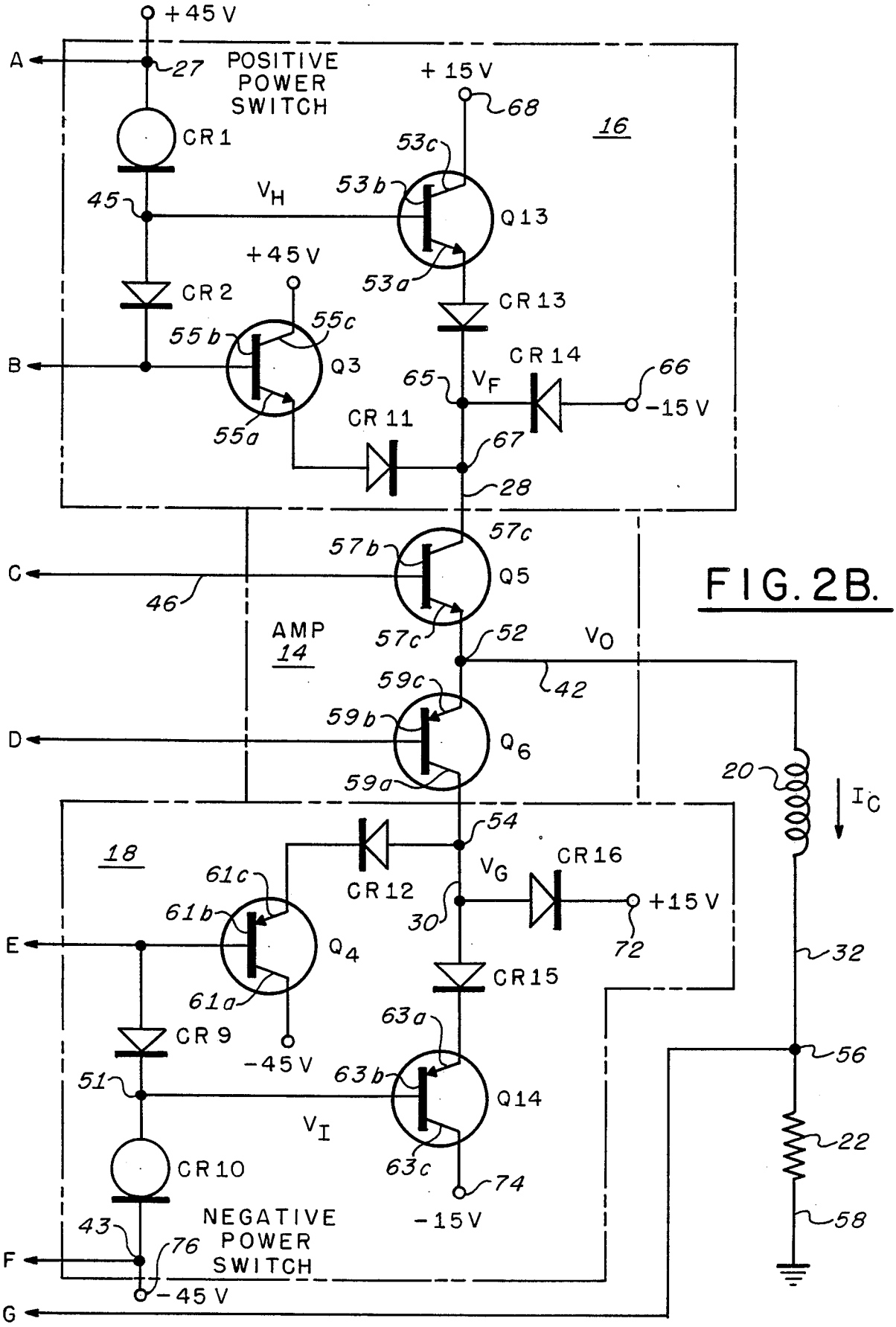
FIGS. 2A and 2B are simplified schematic circuit diagrams of a preferred embodiment of the present invention.
Figure 2A:
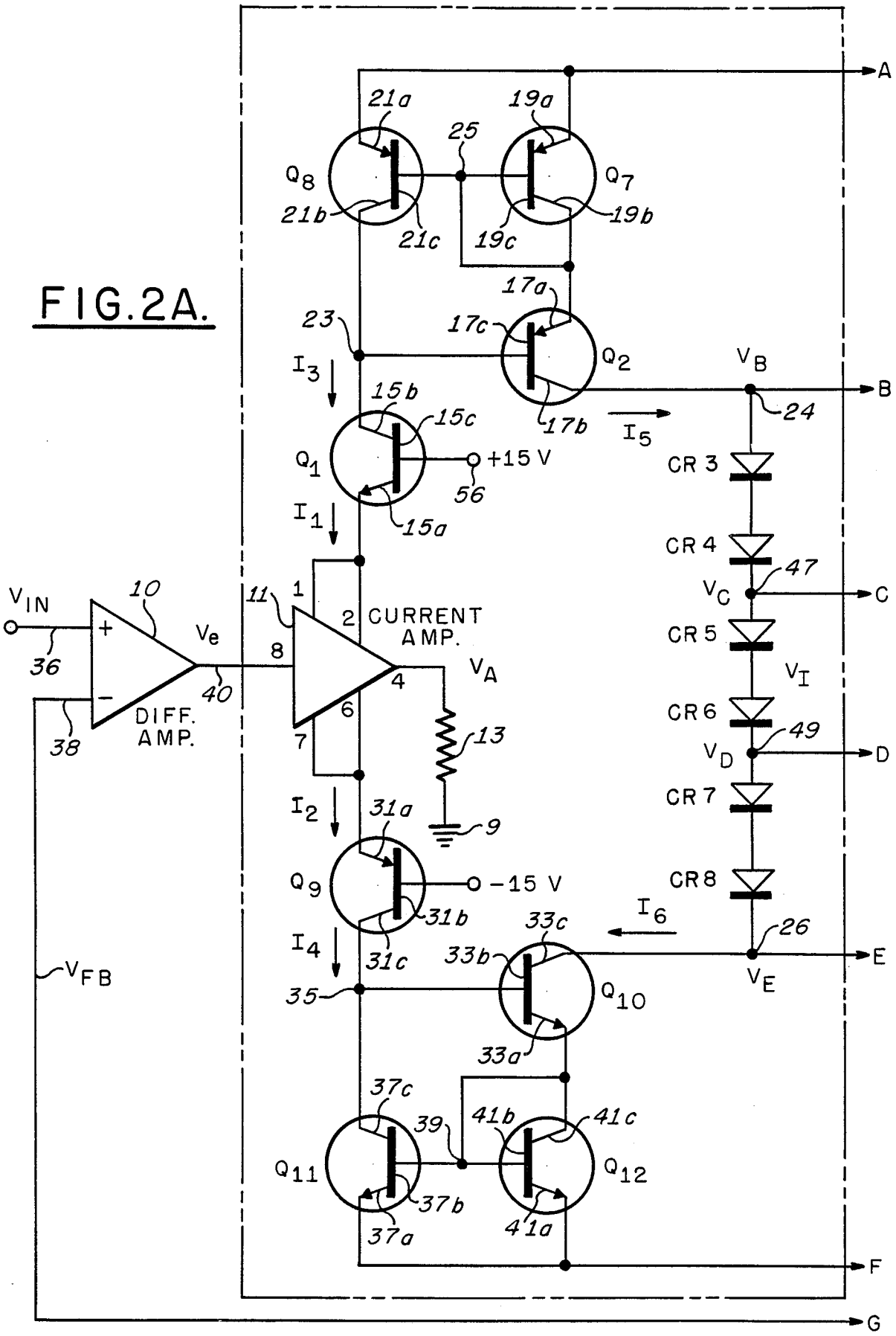

FIG. 2 illustrates a schematic circuit diagram of a preferred embodiment of the invention. Not shown are conventional circuit elements used to enhance the frequency response, increase transistor current gain, and stabilize the system. Input stage 10 is comprised of a conventional differential amplifier coupled to receive the beam deflection signal $V_{IN}$ on line 36 at one input and a feedback signal $V_{FB}$ developed across resistor 22 and coupled at node 56 to a second input on line 38 to sample the curent passing through deflection yoke 20. The output of amplifier 10 is an error voltage $V_e$ which is applied on line 40 to current amplifier 11 of preamplifier 12. Current amplifier 11 draws current from a +15 V supply through transistor Q1 and and from the +45 V supply through transistors Q2, Q7 and Q8. Amplifier 11 draws current $I_1$ at pins 1 and 2 from emitter **15*a* of transistor Q1. Amplifier 11 is further energized at pins 7 and 6 from a −15 V supply through trnsistor Q9 and from a −45 V supply through transistors Q10, Q11, and Q12. The output 4 of amplifier 11 is coupled to load resistor 13, which is connected to ground at reference numeral 9. Coupled between the collectors of transistors Q2 and Q10 are series connected diodes CR3–CR8 which provide predetermined bias voltages $V_B$, $V_C$, $V_D$ and $V_E$. Current amplifier 11 is a unity gain buffer, such as type LH0002 as manufactured by National Semiconductor Corp., Santa Clara, CA. The cathode of diode CR3 is coupled to the anode of diode CR4. The cathode of diode CR4 connects at node 47 to base 57*b* of transistor Q5 and to the anode of diode CR5. The cathode of diode CR5 is coupled to the anode of diode CR6 and the cathode thereof connected at node 49 to the anode of diode CR7 and the base 59*b* of transistor Q6. Diode CR7 has its cathode connected to the anode of diode CR8. A positive voltage source of +15 V at terminal 56 is applied to the base 15*c* of transistor Q1. Transistor $Q_1$ draws current $I_3$ from transistors $Q_2$ and $Q_8$. Transistors Q2, Q7, and Q8 are connected in a PNP Wilson Constant Current Source configuration such as is commonly employed in operational amplifier microcircuits. The base 17*c* of transistor Q2 is coupled to the collector 21*b* of transistor Q8 and the collector 15*b* of transistor Q1 at node 23. Emitter 17*a* of transistor Q2 and collector 19*b* of transistor Q7 are coupled at node 25 to the base 19*c* of transistor Q7 and base 21*c* of transistor Q8. Emitters 19*a* and 21*a* of transistors Q7 and Q8, respectively, are connected in common at node 27 to a positive high voltage supply at terminal 70, typically +45 V. Collector 17*b* of transistor Q2 is coupled to the anode of diode CR3 and the cathode of diode CR2 at node 24**.

Pins 6 and 7 of amplifier 11 are coupled to supply current $I_2$ to emitter **31*a* of NPN transistor Q9. The base 31*b* of transistor Q9 is coupled to a −15 V power source. Transistors Q10, Q11, and Q12 are connected in an NPN Wilson Current Source configuration. The collector 31*c* transistor Q9 is coupled to base 33*b* of transistor Q10 and collector 37*c* of transistor Q11 at node 35. Emitter 33*a* of transistor Q10 is coupled to collector 41*c* and base 41*b* of transistor Q12 and also coupled to base 37*b* of transistor Q11 at node 39. Emitters 37*a* and 41*a* of transistors Q11 and Q12 are coupled at node 43 to a −45 V power supply. The collector 33*c* of transistor Q10 is coupled at node 26 to the base 61*b* of transistor $Q_4$, the cathode of diode CR8, and the anode of diode CR9 of the negative power switch 18**.

The positive power switch 16 is comprised of transistors Q3 and Q13 and diodes CR1, CR2, CR11, CR13, and CR14, and coupled to +15 V, −15 V, and +45 V power supplies. The +45 V power supply at terminal 70 is coupled at node 27 to the anode of a constant current unidirectional conducting element CR1 such as type IN5314, as manufactured by Motorola Semiconductor Corp. The cathode of diode CR1 connects at node 45 to the base **53*b* of transistor Q13 and the anode of diode CR2. The cathode of diode CR2 is coupled at node 24 to the anode of diode CR3, the collector 17b of transistor Q2 and to the base 55b of transistor Q3. The collector 53c of transistor Q13 is connected to a +15 V voltage source at terminal 68. A diode CR13 has its anode coupled to the emitter 53a of transistor Q13 and its base coupled to node 65. A diode CR14 has its anode coupled to a −15 V power source at terminal 66 and the cathode coupled to nodes 65 and 67. Emitter 55a of transistor Q3 is coupled to the anode of diode CR11. Node 67 is coupled to the cathode of diode CR11 and to the collector 57c of transistor Q5. A +45 V supply at terminal 71 is coupled to collector 55c of transistor Q3**.

In a manner similar to positive power switch 16, negative power switch 18 is comprised of transistors Q4 and Q14, diodes CR9, CR10, CR12, CR15, and CR16, and coupled to power sources supplying +15 V, −15 V, and −45 V. The cathode of diode CR9 connects at node 57 to the base 63b of transistor Q14 and the anode of a constant current unidirectional conducting element CR10. The cathode of element CR10 connects at node 43 to the −45 V power source at terminal 76. Emitter 63a of transistor Q14 is connected to the cathode of diode CR15 and collector 63c to a −15 V power source at terminal 74. Collector 59a of transistor Q6 connects to the anodes of diodes CR12, CR15 and CR16 at node 54. The cathode of diode CR12 is coupled to emitter 61c of transistor Q4. Collector 61A of transistor Q4 is connected to a −45 V power source at terminal 69. The cathode of diode CR16 is connected to a +15 v power source at terminal 72. Node 51 is connected to base 63b of transistor Q14.

Push-pull amplifier 14 is comprised of cascaded transistors Q5 and Q6 whose common emitter junction at node 52 is connected via lead 42 to energize deflection coil 20. Node 47 of the diode chain connects via lead 46 to the base 57b of transistor Q5. Emitter 57a of transistor Q5 connects via node 52 to emitter 59c of transistor Q6 and to one end of deflection yoke 20. Node 49 of the diode chain connects to base 59b of transistor Q6. The second end of deflection coil 20 is connected at node 56 to sampling resistor 22 and by line 38 to input the negative of differential amplifier 10. Sampling resistor 22 is terminated to ground at reference numeral 58.

In operation a signal $V_{IN}$ applied to differential amplifier 10 will result in a current $I_O$ proportional thereto in yoke 20. Thus, a positive-going signal applied to lead 36 will result in a positive yoke current, and a negative-going signal applied to lead 36 will result in a negative current in yoke 20. Assuming zero initial conditions, with a positive voltage $V_{IN}$ applied to differential amplifier 10, a positive error voltage $V_e$ will be applied to current amplifier 11. Current is drawn in the direction shown by arrow $I_1$ from the emitter of transistor $Q_1$ to pins 1 and 2 of current amplifier 11. Transistor $Q_1$ acts to buffer current amplifier 11 from the high voltage power sources. Collector current $I_3$ of transistor $Q_1$ is substantially equal in value to emitter current $I_1$. Transistors $Q_7$ and $Q_8$ are a matched pair configured as a Wilson current source and provide a current output $I_5$ at transistor $Q_2$ which is equal in magnitude to the current $I_3$ but oppositely polarized. Amplifier 11 also supplies idle current at pins 6 and 7 to buffer transistor $Q_9$. Thus, the output current $I_4$ at the collector of $Q_9$ is equal to the input current $I_2$ from pins 6 and 7 of amplifier 11 flowing to emitter 31a of transistor $Q_9$. A current $I_6$ at the collector 33c of transistor $Q_{10}$ is drawn through the diode chain $CR_2$–$CR_9$ and is equal in magnitude to the idle current $I_4$. Thereby when error voltage $V_e$ is equal to zero $V_1$ is approximately equal to 0 V and current $I_5=I_6$. As signal $V_e$ becomes more positive, the current $I_5$ will increase relative to the current $I_6$. $I_5$ increases proportional to $V_e$, while the idle current is substantially constant. Accordingly, the voltage $V_1$ will increase positively. Conversely, as signal $V_e$ goes negative, the current $I_6$ will become greater than current $I_5$ and the output voltage $V_1$ becomes negative. In addition to providing output voltage $V_1$, preamplifier 12 provides bias voltages $V_B$, $V_C$, $V_D$ and $V_E$, determined by the predetermined diode voltage drops across CR3–CR8. In operation, with power supplies of ±45 V, the output voltage $V_1$ will range over approximately ±41.5 V.

The function of power control switches 16 and 18 is to supply the collectors of the output transistors $Q_5$ and $Q_6$ with the lowest supply voltage that will permit maintaining linear operation. Thus, either the +45 V, +15 V, or −15 V supplies is selected by the positive power control circuitry and one of the −45 V, −15 V, or +15 V supplies is selected to supply negative output current to the collector of transistor $Q_6$. The sequential operation of the power control switches may be readily understood by consideration of an example. Since the amplifier 14 is driving an inductive load 20, the following polarity conditions for amplifier output voltage $V_O$ and yoke current $I_O$ will exist:

DEFLECTION YOKE POLARITY PARAMETERS

| $I_O$ | $V_O$ |
|---|---|
| Positive | Positive |
| Positive | Negative |
| Negative | Positive |
| Negative | Negative |

Note that unlike a resistive load, a negative output voltage must be developed for positive output current and vice versa under some conditions of operation. All positive output current $I_O$ is supplied by the positive power switch 16, and all negative output current is provided by the negative power switch 18. The power control circuitry will select the lowest supply voltage as a function of the required electron beam deflection rate.

The actual magnitude of the power supplies which are selected by the power switches is a function of the deflection rate of the input signal $V_{IN}$. For illustrative purposes, a sine wave input signal may be selected for $V_{IN}$, which will exercise a deflection amplifier of the type shown in FIG. 2 over a writing rate up to approximately 236 in/sec on a 6"×6" CRT face with 48° on-axis deflection angle.

Figure 3:
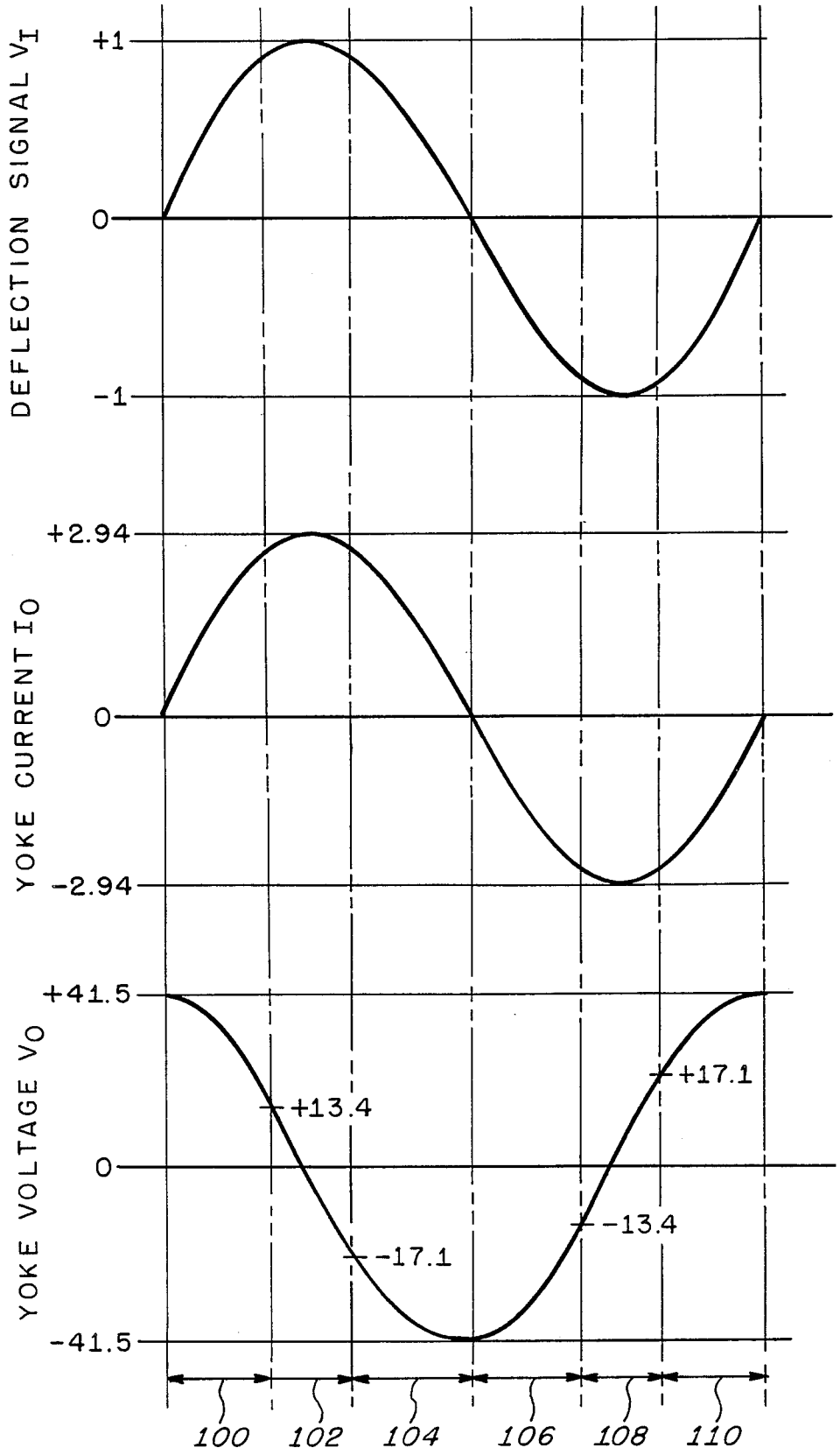
FIG. 3 is a diagram with input and output waveforms for a sinusoidal deflection signal applied to the present invention.

FIG. 3 shows the output voltage waveform $V_O$ required to obtain an output current $I_O$ that is a replica of $V_{IN}$. A sine wave input with a period of 80 μS is chosen for ease of analysis and to illustrate exercising both positive and negative control circuitry. It is assumed that a peak voltage of 1 V is applied. With sine wave input, the rate of change of current through the yoke ranges from 0 A/sec to 230 KA/sec.

The output voltage $V_O$ corresponding to the applied deflection voltage to obtain an output current $I_O$ that is a replica of the applied deflection voltage $V_{IN}$ can be calculated as follows:

$$V_{IN}=\sin(7.85\times10^4 t) \quad (1)$$

$$V_O=L(dI_O)/dt+I_O(R_Y+R_S) \quad (2)$$

where

L=inductance of yoke (180 μh)

$dI_O/dt$=rate of change of output current with respect to time $I_O$=yoke current (amp)

$R_Y$=yoke resistance (0.6 ohm)

$R_S$=sample resistor (0.34 ohm)

Since the output current $I_O$ is forced to be proportional to the deflection voltage $V_{IN}$ by the feedback loop, the magnitude may be found from the relationship:

$$|I_O| = V_{IN}/R_S \quad (3)$$

Since $R_S$ has a typical value of 0.34 ohm, $I_O$ has a peak value of ±2.94 amp, hence $$I_O = 2.94 \sin (7.85 \times 10^4 t) \quad (4)$$

Neglecting the voltage drops across $R_Y$ and $R_S$ and substituting equation (4) and the value for L in (2) yields:

$$V_O = 41.5 \cos (7.85 \times 10^4 t) \quad (5)$$

By considering the losses due to diode and transistor voltage drops and the resulting bias relationships, a table may be constructed which provides the minimum supply voltage required to generate the desired $V_O$ waveform. This is shown in Table 2 below.

TABLE 2

| | SUPPLY VOLTAGES | |
|---|---|---|
| $I_O$ POLARITY | $V_O$ | SUPPLY |
| Positive | −41.5 V to −17.1 V | −15 V |
| Positive | −17.1 V to +13.4 V | +15 V |
| Positive | +13.4 V to +41.5 V | +45 V |
| Negative | +41.5 V to +17.1 V | +15 V |
| Negative | +17.1 V to −13.4 V | −15 V |
| Negative | −13.4 V to −41.5 V | −45 V |

Figure 4:
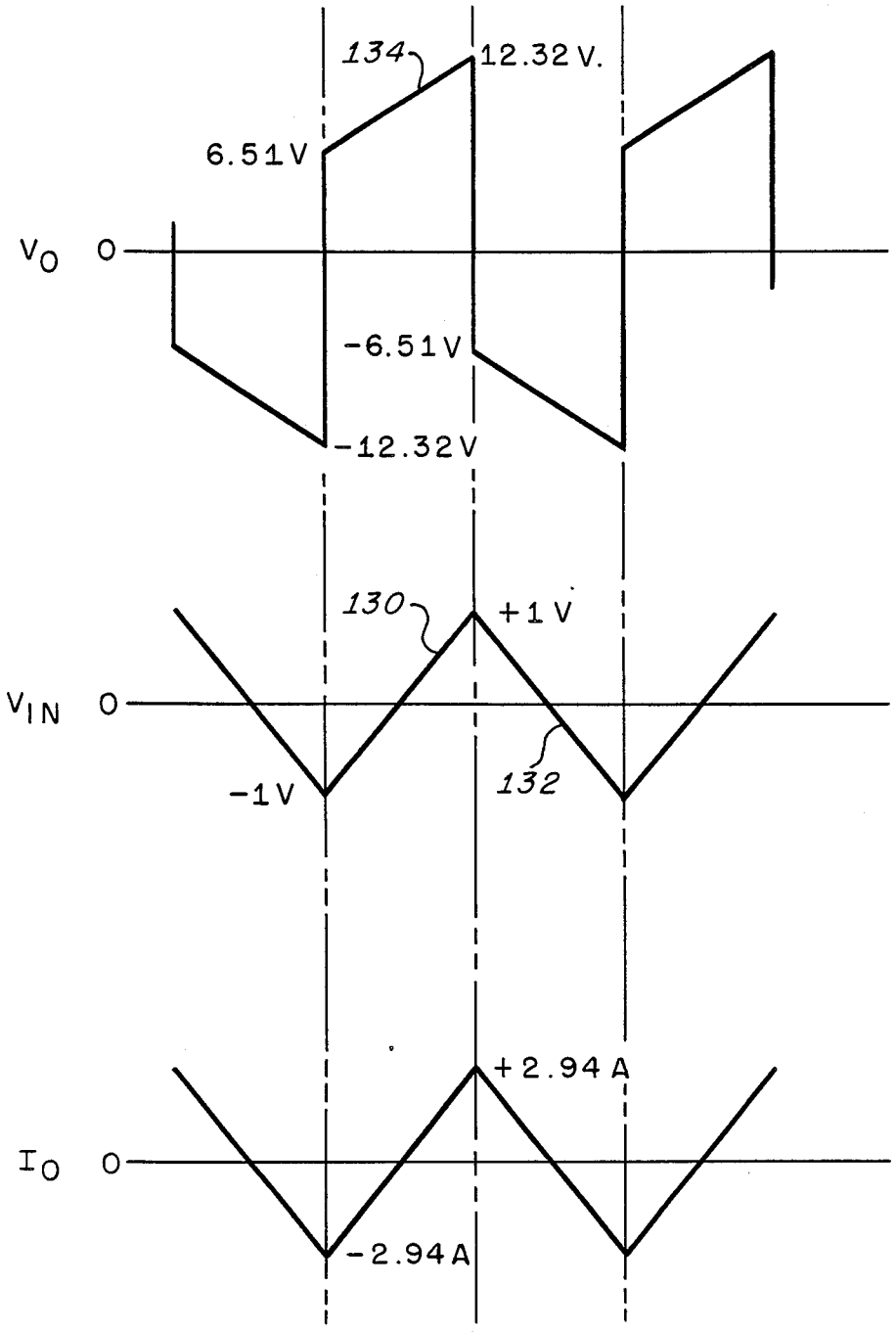
FIG. 4 shows input and output waveforms for a triangular deflection signal useful in understanding the operation of the present invention.

The effect of the yoke and sampling resistor voltage drops may be readily observed by considering a linear waveform, as in FIG. 4. A sawtooth voltge $V_{IN}$ of one volt peak value is applied as the deflection waveform. The output waveform $V_O$ to obtain a yoke current $I_O$ that is a replica of $V_{IN}$ is found from equation (2). Assuming a deflection writing rate of 35 Kin/sec and a deflection sensitivity of 3.1 A for center to edge deflection on a 6"×6" display, $$V_O = (180\ \mu h)(35\ \text{Kin/sec})(3.1\ \text{A}/3\ \text{in}) + I_O(0.6 + 0.34\ \text{ohms}) \quad (6)$$

For positive deflection as shown at point 130

$$V_O = 6.51 + 0.94\, I_O \quad (7)$$

For negative deflection as at point 132

$$V_O = -6.51 + 0.94\, I_O \quad (8)$$

The current $I_O$ is $$I_O = (\pm 35\ \text{kin/sec})(3.1\ \text{A}/3\ \text{in}) = (\pm 36.17\ \text{KA/sec})t \quad (9)$$

Substituting (9) in (7) and (8) yields $$V_O = 6.51 + 34 \times 10^3 t \quad (10)$$

and $$V_O = -6.51 - 34 \times 10^3 t \quad (11)$$

For a deflection period of 171 μs, this results in a peak deflection amplitude of ±12.32 V. Referring to waveform $V_O$ at point 134, it may be seen that the effect of increasing yoke current is to increase the voltage drop due to series resistances $R_Y$ and $R_S$, hence requiring an increasing yoke voltage $V_O$. Referring to Table 2, it is seen that when $I_O$ is positive and $V_O$ between 9.41 V and 12.32 V, the +15 V supply will be applied; when $I_O$ is positive and $V_O$ between −6.51 V and −9.41 V, the +15 V supply is applied. When $I_O$ is negative and $V_O$ is between −9.41 V and −12.32 V, or $I_O$ negative and $V_O$ between +6.5 V and +9.41 V, the −15 V supply is applied. Thus, at the reduced writing speed, the system automatically selects the lowest voltage supplies.

In operation, the required supply voltage will be a function of the desired output voltage and the polarity of output current, which in turn depends on the yoke inductances and rate of deflection of the electron beam. FIG. 3 shows a family of waveforms corresponding to a sinusoidal deflection voltage $V_{IN}$. Curve $I_{IN}$ shows a sine wave with amplitude 2 V peak-to-peak. The time base is divided into six intervals 100, 102, 104, 106, 108 and 110, each interval corresponding to the utilization of a particular power supply. While six supplies have been chosen for illustrative purposes, this is by way of example only and in principle the number of supplies may be extended or diminished. Corresponding to the deflection voltage curve $V_{IN}$ is the curve $V_O$ of the output voltage across deflection coil 20. Since the coil is primarily inductive, the output voltage is shifted in phase by 90° in relation to the current $I_O$. As an example, for the desired deflection on the CRT, a peak-to-peak amplitude of 93 V is required. The current waveform $I_O$ is in phase with the deflection voltage $V_{IN}$ by virtue of the feedback circuitry which forces the current waveform to be identical to the deflection voltage. The yoke current is scaled for a peak-to-peak value of 5.88 A, which corresponds to a peak current of 2.94 A. Table 2 identifies the power supply voltage applied for each of the six intervals.

Referring now to FIG. 3 with continued reference to FIG. 2, the operation of the positive power switch 16 will be considered in detail. Positive power switch 16 selects substantially the lowest supply voltage required to provide the desired output voltage $V_O$. During interval 100 the output voltage $V_O$ ranges between +41.5 and +13.4 V. Transistor $Q_3$ and diode CR11 are biased into conduction while transistor $Q_{13}$ and diode CR13 are not conducting. Diode CR14 is back biased and not conducting. Diode CR2 is back biased and not conducting. Thus, transistor $Q_3$ and diode CR11 conduct the output current from the +45 V supply at terminal 71 while the current paths from the +15 V and −15 V supplies are interrupted. Diode CR1 essentially provides a constant current source and isolation of loading effects on the +45 V supply.

Consider now interval 102 of FIG. 3. The output voltage $V_O$ is seen to range between +13.4 V and −17.1 V. Over this range, the voltage at node 65 will vary between −15.7 V and +14.1 V. Diodes CR11 and CR14 will be biased for nonconduction over substantially the entire range. The voltage at node 45 varies from −14.3 V to +15.5 V, while at node 65 it varies between −15.7 V and +14.1 V, so that transistor $Q_{13}$ is biased for conduction. Diode CR13 is forward biased so that the output current $I_O$ is supplied by the +15 V supply at terminal 68. The voltage at collector 57c of transistor $Q_5$ will be between 0.7 to 1.4 V above the output voltage $V_O$ and therefore transistor $Q_5$ is always kept out of saturation. Considering now the operation of transistor $Q_3$ and diode CR11, during interval 102 the voltage applied between nodes 24 and 67 is insufficient to bias the components to conductivity. Therefore, transistor $Q_3$ and diode CR11 will be nonconducting for output voltage $V_O$ ranging from −17.1 to +13.4 V.

When the output voltage $V_O$ is between −41.5 V and −17.1 V as in interval 104, diode CR14 will be biased for conduction. Assuming a typical diode voltage drop of 0.7 V, the voltage $V_F$ at node 65 will be −15.7 V. Similarly, considering the diode voltage drops for CR3, CR4 and transistor $Q_5$ the voltage $V_B$ at node 24 appearing at base 55b of transistor $Q_3$ will be $V_O$+2.1 V. Therefore, for $V_O$ between −41.5 V and −7.1 V, voltage $V_B$ at node 24 will range between −39.4 V and −15 V. It may be seen then that the voltage difference between nodes 65 and 24 will range between −23.7 V to 0.7 V. Since this voltage must be at least 1.4 V to forward bias diode CR11 and transistor $Q_3$, transistor $Q_3$ is turned off for $V_O$ ranging between −41.5 V to −17.1 V. Similarly, by counting diode drops for diodes CR2, CR3, CR4 and transistor $Q_5$ it may be shown that the voltage difference between nodes 45 and 65 will range from −23 V to +1.4 V. Therefore transistor $Q_{13}$ will be turned on when the voltage difference applied between the base 53b of transistor $Q_{13}$ and the cathode of diode CR13 equals 1.4 V, and thus will be turned off for values of $V_O$ less than −17.1 V. For $V_O$ ranging from −41.5 V to −17.1 V diode CR14 conducts output current $I_O$ from the −15 V supply at terminal 66 while diodes CR11 and CR13 are back biased and therefore not conducting current. Hence, the +45 V and +15 V supplies are disconnected.

The operation of the system during intervals 106–110 is similar except that negative power switch 18 will be operative in a similar manner to that of the positive power switch described above. Thus, during interval 110 the yoke voltage $V_O$ ranges between +41.5 to +17.1 V and is energized by the +15 V supply at terminal 72 acting through diode CR16 and transistor $Q_6$. Diodes CR12 and CR16 will be biased to nonconduction so that the −15 V supply at terminal 74 and the −45 V supply at terminal 69 do not provide output current. During interval 108 wherein $V_O$ ranges between +17.1 and −13.4 V, power is supplied by the −15 V supply at terminal 74 through diode CR15 and transistor $Q_{14}$ and $Q_6$. Diodes CR9, CR12, and CR16 are reverse biased, while CR9 is conducting. Finally, during interval 106 where $V_O$ ranges between −13.4 and −41.5 V, transistor $Q_{14}$ and diodes CR15 and CR16 are in a nonconducting state, while diode CR12 is forward biased, so that current is supplied from the −45 V supply at terminal 69 through diode CR12 and transistor $Q_4$ to transistor $Q_6$.

Figure 5:
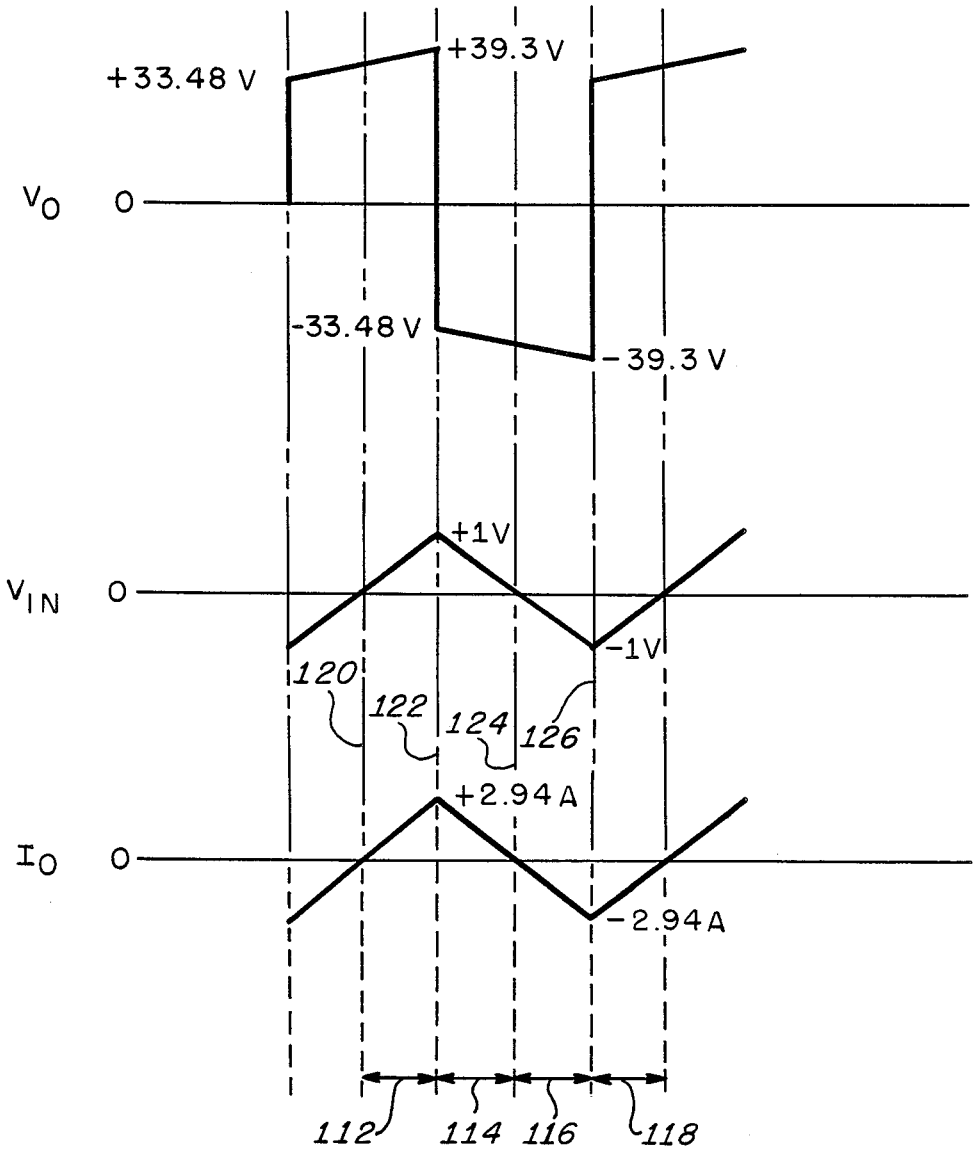
FIG. 5 is a diagram illustrating input and output waveforms at a high writing speed.

It may be seen that the greater the rate of change of deflection voltage the higher the value of the power supply required. This can be shown by an additional example using a writing speed of 180 Kin/sec. Referring now to FIG. 5, $V_{IN}$ represents a triangular waveform with a peak value of 1 V. The corresponding deflection yoke current $I_O$ is also a triangular waveform of peak amplitude 2.94 A whose magnitude has been determined as described above. It may be seen that the voltage waveform $V_O$ describes a ramp increasing from 33.48 V to 39.3 V and decreasing from −33.48 V to −39.3 V. The intervals 112, 114, 116, 118 of FIG. 5 designate time intervals corresponding to operation of the power switching circuitry. Choosing the V baseline for the beginning of the control sequence designated by line 120, $V_{IN}$ is 0 V, $I_O$ is 0 A, and $V_O$ is 36.4 V. The positive voltage $V_{IN}$ applied to amplifier 10 results in a positive voltage $V_1$ at the cathode of diode CR5. Bias $V_H$=15.5 V applied to the base 53b of transistor $Q_{13}$ and 37.1 V applied to the cathode of CR13 through diode CR11 and transistor $Q_3$, results in reverse biasing transistor $Q_{13}$ and diode CR13 by a value of −21.6 V. Since the voltage at the anode of diode CR14 is −15 V, and $V_F$ applied at node 65 to the anode of diode CR14 is 37.1 V, diode CR14 is reverse biased. Therefore no current flows from the −15 V power supply at terminal 66. Since positive current is being supplied and can only flow through the upper transistor $Q_5$ of push-pull amplifier 14, transistors $Q_6$, $Q_4$, and $Q_{14}$ are nonconducting. Transistor $Q_3$ is turned on by the positive bias $V_B$ resulting from the positive signal $V_{IN}$ applied to amplifier 10. Thus, output current is provided from the +45 V supply at terminal 71 through transistor $Q_3$ and diode CR11 to transistor $Q_5$ and deflection coil 20. This is consistent with Table 2 for positive yoke current. The diodes and transistors remain in the same state throughout interval 112 while the output voltage $V_O$ and the output current $I_O$ continue to rise as shown in FIG. 5.

At the end of interval 112, denoted by line 122, the output voltage $V_O$ has reached a value of 39.3 V and yoke current $I_O$ is at a peak value of 2.94 A. In order to provide the decreasing yoke current shown by region 114, the output voltage must be immediately reduced to −33.48 V. Amplifier 10 senses the change in deflection voltage $V_{IN}$ and causes $V_1$ to decrease until $V_O$ has reached a value of −33.48 V. Since $I_O$ is still positive, although decreasing, transistors $Q_6$, $Q_4$, and $Q_{14}$ remain in a nonconducting state. However, the state of the positive power switching circuitry changes as follows: transistor $Q_3$ and diode CR11 are turned off because of the high negative bias appearing at node 24 coupled from the output voltage $V_O$, allowing for the diode voltage drops in CR3, CR4 and $Q_5$; the voltage $V_B$ at the base 55b of transistor $Q_3$ is approximately −31.4 V. Since diode CR14 clamps $V_F$ to −15.7 V, and since voltage $V_B$ and base 55b of transistor $Q_3$ is −31.4 V, diode CR11 and transistor $Q_3$ are back biased. Transistor $Q_{13}$ and diode CR13 are back biased because the voltage at node 45 and base 53b of transistor $Q_{13}$ is −30.7 V, while the voltage at node 65 is −15.7 V. Since diode CR14 is biased for conduction, the output current $I_O$ is supplied from the −15 V power supply terminal 66 and controlled by transistor $Q_5$. These conductive states continue through interval 114.

At the end of interval 114, denoted by line 124, the output voltage $V_O$ is continuing to decrease while $V_{IN}$ reaches a value of 0 V and $I_O$ has a value of 0 A. At this point, entering interval 116, the output current $I_O$ changes in polarity from positive to negative. Therefore, transistor $Q_5$ and diode CR14 no longer conduct current and the output current is provided through transistors $Q_4$ and $Q_6$ and diode CR12 from the −45 V supply at terminal 69. Diode CR16 is reverse biased by the negative voltage $V_G$ applied at anode junction 54, which has a value of approximately −37.1 V, and the +15 V supply at the cathode. A negative potential of $-15.5$ V appears at node 51 and is applied to the base 63b of transistor $Q_{14}$, while $V_G=-37.1$ V is applied to the anode of CR15, so that PNP transistor $Q_{14}$ and diode CR15 are nonconductioning. Therefore no current flows from the $-15$ V supply at terminal 74. These conductive states continue throughout interval 116.

At the end of interval 116, denoted by line 126, the yoke voltage $V_O$ has reached a value of $-39.3$ V, the output current $I_O$ is at a value of $-2.94$ A, and the deflection voltage $V_{IN}$ is $-1$ V. Since $V_{IN}$ now commences to increase in a positive direction, $V_O$ must rapidly change from $-39.3$ V to a value of $+33.48$ V in order to provide the required increase in yoke current. Since the output current $I_O$ is negative at this point, transistors $Q_3$, $Q_{13}$, and $Q_5$ remain nonconducting. However, as $V_O$ increases, negative power switch 18 changes state in the following manner. The positive voltage of 33.48 V developed across yoke 20 results in biasing diode CR16 to be conductive and supplies current $I_O$ from the $+15$ V supply at terminal 72 through transistor $Q_6$. Transistor $Q_4$ and diode CR12 are reverse biased by the positive voltage $V_E$-$V_G$ applied to node 26 with respect to node 54, so that the $-45$ V supply is disconnected. Transistor $Q_{14}$ and diode CR15 remain nonconducting because of the positive bias $V_I$-$V_G$ applied between nodes 51 and 54. Therefore no current is provided by the $-15$ V supply at terminal 74. The foregoing conditions continue through interval 118. At the end of interval 118, the output current $I_O$ increases to positive polarity. Therefore transistor $Q_6$ and diode CR16 stop conducting current while transistors $Q_3$ and $Q_5$ and diode CR11 are biased for positive conduction. Diode CR14 is reversed biased by the positive voltage $V_F=37.1$ V applied from transistor $Q_5$ to node 65 and the negative $-15$ V supply at the anode. Therefore no current flows from the $-15$ V power supply at terminal 66. Transistor $Q_{13}$ and diode CR13 remain nonconducting because of the negative bias $V_H-V_F=-21.6$ V applied between nodes 45 and 65. This completes a full cycle of operation.

It should be noted that for this mode of operation (180 Kin/sec) transistors $Q_{13}$ and $Q_{14}$ remain off for the entire cycle and current does not flow through diodes CR13 and CR15. It may be seen from Table 2 that since the output voltage $V_O$ is not required to develop values in the range of $-17.1$ V to $+13.4$ V for positive $I_O$ and $+17.1$ V to $-13.4$ V for negative $I_O$ the plus and minus 15 V power supplies are not required and transistors $Q_{13}$ and $Q_{14}$ are not exercized. Conversely, if the writing speed is decreased to $\pm35$ Kin/sec, as in the earlier example, transistors $Q_{13}$ and $Q_{14}$ and the $\pm15$ V power supplies are adequate to supply the current throughout the cycle and therefore transistors $Q_3$ and $Q_4$ and diodes CR11, CR12 CR14 and CR16 remain nonconducting. When the writing speed is increased to, for example, 180 Kin/sec, then the $\pm45$ V power supplies will be required.

It may be seen from the foregoing that the invention provides the following advantages:

a. High power efficiency by applying substantially the minimum power supply voltage necessary to assure linear operation.

b. Automatic Switches to provide the minimum power level consistent with the deflection rate.

c. Minimizes power dissipation in both raster and stroke modes of operation.

d. Provides high rate slew rate capability during stroke writing.

e. Does not require auxiliary control signals and associated circuitry.

While the invention has been described in its preferred embodiments, it is to be understood that the words which have been used are words of description rather than limitation and that changes may be made within the purview of the appended claims without departing from the true scope and spirit of the invention in its broader aspects.

What is claimed is:

1. An electron beam magnetic deflection system for a display system controllably operable to provide deflection in a stroke mode for random deflection of the beam, a raster mode for periodic deflection of the beam, and a slew mode for traversing the beam at a maximum deflection rate, comprising:

input means, having an input terminal responsive to an input signal indicative of a desired deflection of the beam, for providing an output signal responsive to said input signal;

preamplifier means, comprising a buffer amplifier responsive to said output signal and providing an output current indicative of the magnitude and sense of said output signal, current source means, responsive to said output current, for providing a further output current opposite in sense to said output current, a plurality of cascaded diodes providing predetermined voltage drops and coupled to receive said further output current, for providing a plurality of predetermined bias voltages and a variable bias signal responsive to said input signal for energizing a deflection amplifier means;

said deflection amplifier means having first and second cascaded sections, coupled to receive ones of said bias voltages, for applying current to a deflection coil operatively coupled to said electron beam, and for providing a desired beam deflection in accordance with the sense and rate of change of said input signal;

a plurality of switch means, operable in non-saturated switching mode for selectively applying voltage sources of positive and negative polarity to said first and second cascaded sections, responsive to said further output current, from said preamplifier means, to said current in said deflection coil, and to a source of voltage derived from a difference of a voltage developed across said deflection coil and a voltage drop across one of said first or second sections of said deflection amplifier means, a predetermined one of said switch means being activated for a predetermined polarity of said deflection current when said derived voltage attains a first predetermined magnitude and polarity and deactivated when said derived voltage attains a second predetermined magnitude and polarity, said first section of said deflection amplifier means coupled to ones of said switch means for energizing said electron beam in a first predetermined direction and said second section coupled to further ones of said plurality of switches for energizing said electron beam in a second predetermined direction; and a plurality of voltage sources of predetermined magnitudes and first and second polarities, ones of said voltage sources coupled respectively to ones of said plurality of switch means, whereby a voltage source of sufficient magnitude is provided to said deflection amplifier means which allows sufficient current to flow through said deflection coil to accomplish the desired rate of change of beam deflection while maintaining linear operation of said deflection amplifier means and minimizing power consumption thereof, independent of the mode of operation of said display system.

2. The system of claim 1 wherein said deflection amplifier means comprises a push-pull amplifier, said first and second sections comprising of cascaded transistors, each of said transistors having a base electrode for receiving a control bias from said preamplifier means and an emitter electrode coupled in common and to said deflection coil, one of said transistor having a collector coupled to one of said plurality of switches and a further one of said transistors having a collector coupled to a further one of said plurality of switches.

3. The system of claim 2 wherein said switch means comprises a first transistor having a base, a collector, and an emitter electrode, said base being coupled to a source of constant current and to one of said cascaded diodes, said collector coupled to one of said plurality of voltage sources of a predetermined polarity and magnitude, said emitter coupled to first diode means, said first diode means energized in response to sums of said derived voltage and said biases applied to said base electrode, said first diode means coupled to second and third diode means, said first, second, and third diode means coupled for unidirectional current conductivity to one of said collectors of said first and second cascaded transistors, said second diode coupled to receive a further one of said voltage sources of predetermined magnitude and polarity; and a second transistor, having a base, an emitter, and a collector electrode, said base thereof coupled to a further one of said cascaded diodes whereby a predetermined voltage differential is maintained between said first mentioned and said second mentioned base electrodes said collector of said second transistor coupled to receive a still further one of said voltage sources of predetermined magnitude and polarity, said emitter of said second transistor coupled to energize said third diode in response to said bias voltges and said voltage drops.

4. The system of claim 3, wherein said preamplifier means further comprises first output means coupled to a load resistance, terminal means coupled to control current in said current source means, said terminal means coupled to an emitter electrode of a transistor also having base and collector electrodes, said base coupled to a power source, said collector coupled to said current source means; said current source means comprising of a pair of transistors having base, collector and emitter electrodes, said emitter electrodes of said pair coupled in common to a further power source, said base electrodes of said pair coupled in common to the emitter of a further transistor having base, collector, and emitter electrodes, said collector electrode of said first mentioned transistor coupled to said base electrode of said further transistor and to a first collector electrode of said transistor pair, said emitter of said further transistor also coupled to a second collector electrode of said transistor pair, said collector of said further transistor coupled to said cascaded diodes and to one of said base electrodes of said deflection amplifier, whereby said terminal means provides a first predetermined current proportional to said output signal to said first mentioned transistor, and said collector of said further transistor provides a second predetermined current in a sense opposing said first predetermined current to said cascaded diodes.

5. The system of claim 4, wherein said input means further comprises a differential amplifier having first and second inputs, said first input being responsive to said input signal; and further comprising an impedance connected in series with said deflection coil for providing a voltage representative of a current flowing therethrough and fed back to said second input for comparison with said input signal, for deriving an error signal indicative of the difference between said input and fed back signals for controlling the current supplied by said deflection amplifier means in linear operation.

6. The system of claim 5, wherein said first input comprises a non-inverting input and said second input comprises one inverting input.

7. A deflection system for a cathode-ray tube employing a magnetic deflection coil to position the beam of the cathode ray tube along the face thereof, comprising:

differential amplifier means having an input connected to receive signals for positioning said beam in a plurality of operational modes, feedback means for providing a voltage representative of the current through said deflection coil to said input of said differential amplifier means, deflection amplifier means for supplying current to said deflection coil, a first source of voltage for supplying positive current to said deflection coil through said deflection amplifier means, a second source of voltage for supplying negative current to said deflection coil through said deflection amplifier means, preamplifier means coupled to receive said beam positioning signals and to provide control signals to said deflection amplifier means, and switch means connected to receive further control signals from said preamplifier means, and responsive to differences of voltages developed by said deflection coil and said voltage sources, said differences representative of the rate of change of current through said deflection coil, for selectively applying one of said voltage sources to said deflection amplifier when a first predetermined voltage is developed across said deflection coil and said current in said deflection coil has a predetermined polarity, and for applying one other than said one of said voltage sources when a second predetermined voltage is developed across said deflection coil, and for supplying currents in said predetermined polarity to said deflection coil, whereby said voltage sources are selectively and independently applied in raster, stroke, and slew modes for maintaining linear operation while minimizing power consumption.

* * * * *